United States Patent [19]

Sugiura

[11] Patent Number: 4,556,031

[45] Date of Patent: Dec. 3, 1985

[54] SYSTEM FOR CONTROLLING A CARBURETOR OF AN INTERNAL COMBUSTION ENGINE

[75] Inventor: Katsuhiko Sugiura, Tama, Japan

[73] Assignee: Fuji Jukogyo Kabushiki Kaisha, Tokyo, Japan

[21] Appl. No.: 567,982

[22] Filed: Jan. 4, 1984

[30] Foreign Application Priority Data

Jan. 7, 1983 [JP] Japan ..... 58-001518

[51] Int. Cl.[4] ..... F02M 5/08

[52] U.S. Cl. ..... 123/437; 261/DIG. 51; 261/DIG. 67; 261/DIG. 81

[58] Field of Search ..... 123/437, 52 M, 559; 261/68, DIG. 50, DIG. 51, DIG. 67, DIG. 81

[56] References Cited

U.S. PATENT DOCUMENTS

| | | | |
|---|---|---|---|
| 4,098,247 | 7/1978 | Konishi et al. | 261/DIG. 67 X |
| 4,283,356 | 8/1981 | Arai et al. | 261/DIG. 67 X |
| 4,376,738 | 3/1983 | Reinmuth | 261/DIG. 67 X |
| 4,444,013 | 4/1984 | Inoue et al. | 123/52 M X |

FOREIGN PATENT DOCUMENTS

| | | | |
|---|---|---|---|
| 0480238 | 7/1929 | Fed. Rep. of Germany | 261/DIG. 51 |
| 2219880 | 10/1973 | Fed. Rep. of Germany | 261/DIG. 67 |

*Primary Examiner*—Parshotam S. Lall
*Assistant Examiner*—W. R. Wolfe
*Attorney, Agent, or Firm*—Martin A. Farber

[57] ABSTRACT

A system for controlling a carburetor of an engine provided with a supercharger. A passage is provided for communicating a float chamber of the carburetor with an intake passage through a changeover valve. A vent pipe is provided for communicating the float chamber with the intake passage. The changeover valve comprises a diaphragm, a vacuum operated chamber defined by the diaphragm, a valve body operatively connected to the diaphragm, a passage for communicating the vacuum operated chamber with the intake passage at the downstream side of the carburetor, an opening for communicating the float chamber with the intake passage, and an opening for communicating the float chamber with the atmosphere. The vacuum operated chamber and the valve body are so arranged that the valve body closes the first opening and opens the second opening at light load to communicate the float chamber with the atmosphere.

5 Claims, 2 Drawing Figures

SYSTEM FOR CONTROLLING A CARBURETOR OF AN INTERNAL COMBUSTION ENGINE

BACKGROUND OF THE INVENTION

The present invention relates to a system for controlling a carburetor of an engine mounted on a vehicle having a supercharger.

In an engine provided with a carburetor having a float chamber, if air pressure in the venturi of the carburetor is during a positive pressure at supercharging, fuel can not be supplied from the carburetor to the venturi, because air pressure in the float chamber is at atmospheric pressure. Japanese utility model application laid open No. 50-20929 discloses a system intended to solve such a problem. According to the prior art, the supercharging pressure is applied to the float chamber, so that fuel in the float chamber is fed to the venturi by the pressure difference between the float chamber and the venturi. In the system, the float chamber is always communicated with the intake passage of the engine through a supercharging pressure-applying passage. Accordingly, the float chamber is subject to be heated by the heat transmitted from the supercharger through the intake air. In addition, the temperature of the intake air is raised in dependency on the compression of the air by the compressor of the supercharger and the heat of the hot air is transmitted to the float chamber through the body of the carburetor.

On the other hand, under light load conditions, the pressure in the float chamber decreases with a decrease of the supercharging pressure. Therefore, percolation of fuel in the float chamber occurs because of the high temperature of the chamber and the low pressure therein, which will cause extreme enrichment of the air-fuel mixture.

SUMMARY OF THE INVENTION

The object of the present invention is to provide a system which eliminates the above-described disadvantage of the prior art.

According to the present invention, there is provided a system for controlling a carburetor of an engine provided with a supercharger having a compressor, comprising: an intake pipe connected to said compressor at an end thereof; a chamber communicated with the other end of said intake pipe; a float chamber provided for supplying fuel to said carburetor; passage means comprising a first passage communicating with said chamber and a second passage communicating with said float chamber; an intake passage for communicating said intake pipe with said carburetor; a vent pipe for communicating said float chamber with said intake passage; a changeover valve provided between said first and second passages, said changeover valve comprising a diaphragm, a vacuum operated chamber defined by said diaphragm, a valve body operatively connected to said diaphragm, a third passage for communicating said vacuum operated chamber with said intake passage at the downstream side of said carburetor, a first opening for communicating said second passage with said first passage so as to communicate the float chamber with said intake pipe, and a second opening for communicating said second passage with the atmosphere; said vacuum operated chamber and said third passage being so arranged that said valve body closes said first opening and opens said second opening under light load conditions to communicate said float chamber with the atmosphere.

The other objects and features of this invention will be apparently understood from the following description with reference to the accompanying drawings.

DETAILED DESCRIPTION OF THE PREFERRED EMBODIMENT

Figure 1:
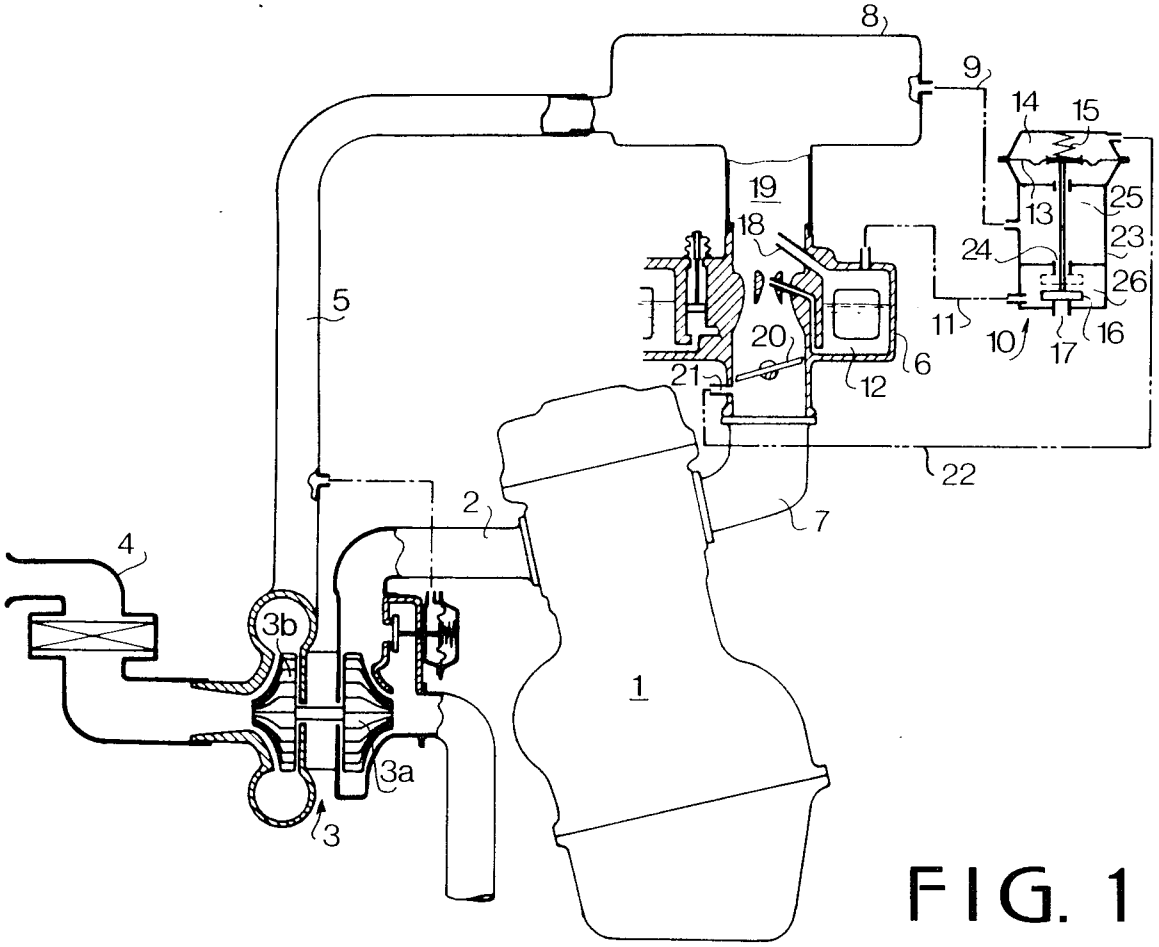
FIG. 1 is a schematic view showing a system according to the present invention.

Referring to FIG. 1, an internal combustion engine 1 is provided with a turbocharger 3 as a supercharger. The turbocharger 3 comprises a turbine 3*a* provided in an exhaust pipe 2 and a compressor 3*b* provided in an intake pipe 5 at the downstream side of an air-cleaner 4. The intake pipe 5 is communicated with an intake passage 19 at the upstream side of a carburetor 6 through a chamber 8 having a predetermined volume. The chamber 8 serves to diminish the intake air pressure pulsation. The carburetor 6 communicates with the engine 1 through an intake manifold 7 and comprises a float chamber 12 and a throttle valve 20.

In accordance with the present invention, a changeover valve 10 is provided. The changeover valve 10 comprises a housing 23, a vacuum operated chamber 14 defined by a diaphragm 13, a first opening 24 for communicating the intake pipe with the float chamber 12, a second opening 17 for communicating the float chamber with the atmosphere, a valve body 16 operatively connected to the diaphragm 13, and a spring 15 for urging the valve body 16 to the second opening 17 to close it. A first chamber 25 in the changeover valve is communicated with the intake pipe 5 through a passage 9 and the chamber 8, and a second chamber 26 is communicated with the float chamber 12 through a passage 11. The float chamber 12 is communicated with the intake passage 19 through a vent pipe 18. Further, the vacuum operated chamber 14 is communicated with the intake manifold 7 through a passage 22. The passage 22 is communicated with the intake manifold through a port 21 which is at a position slightly downstream side of the closed position of the throttle valve 20.

Figure 2:
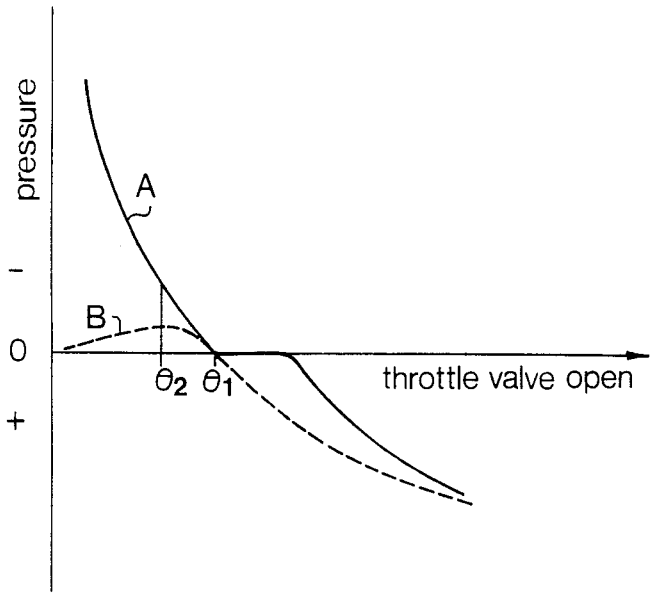
FIG. 2 is a graph showing pressure characteristics of intake air pressure in an intake passage.

In operation, under light load conditions, the opening degree of the throttle valve 20 is small, so that the port 21 is at the downstream side of the throttle valve 20. Accordingly, the pressure at the port 21 is at high negative pressure as shown by A in FIG. 2. The negative pressure is applied to the vacuum operated chamber 14 to deflect the diaphragm 13 against the biasing of the spring 15, so that the valve body 16 is moved to open the second opening 17 and to close the first opening 24 as shown by dashed line in FIG. 1. Thus, the float chamber 12 is communicated with the atmosphere. At that time, the pressure in the intake passage 19 is at a negative pressure as shown by B in FIG. 2. By the negative pressure, the atmosphere is sucked in the intake passage 19 through the opening 17, passage 11, float chamber 12, and vent pipe 18. Therefore, vaporization of fuel in the float chamber is promoted, so that the temperature of the surface of the fuel decreases because of the latent heat of the vaporization. The decrease of the temperature causes the convection in the fuel in the float chamber, so that the temperature of the fuel decreases. Thus, the percolation can be effectively prevented.

When the opening degree of the throttle valve 20 exceeds a degree $\theta_2$, the vacuum in the vacuum operated chamber 14 decreases to such an extent that the spring 15 deflects the diaphragm 13. Thus, the valve body 16 closes the second opening 17 and the first opening 24 is opened. Accordingly, the float chamber 12 is communicated with the intake pipe 5 through passage 11, chambers 26 and 25, passage 9 and chamber 8. When the opening magnitude of the throttle valve 20 exceeds a degree $\theta_1$, the supercharging pressure by the turbocharger 3 reaches to a high value sufficient to perform supercharging. The high supercharging pressure is applied to the float chamber 12 via the first opening 24. Thus, the fuel in the float chamber is supplied to the intake passage 19 by the difference between the supercharging pressure and the pressure at the venturi of the carburetor.

From the foregoing, it will be understood that the present invention provides a system which operates to decrease the temperature of the fuel in the float chamber under light load conditions so as to prevent percolation.

While the presently preferred embodiment of the present invention has been shown and described, it is to be understood that this disclosure is for the purpose of illustration and that various charges and modifications may be made without departing from the spirit and scope of the invention as set forth in the appended claims.

What is claimed is:

1. A system for controlling a carburetor of an engine provided with a supercharger having a compressor, comprising:

an intake pipe at an end thereof connected to said compressor;

a chamber communicated with the other end of said intake pipe;

said carburetor includes means comprising a float chamber for supplying fuel to said carburetor;

passage means comprising a first passage communicating with said first-mentioned chamber and a second passage communicating with said float chamber;

an intake passage for communicating said intake pipe with said carburetor via said first-mentioned chamber;

said carburetor includes a vent pipe communicating said float chamber with said intake passage;

a changeover valve means responsive to said intake passage at a downstream side of said carburetor at heavy load conditions of the engine for communicating said first and second passages, and respectively at light load conditions of the engine for communicating said float chamber with atmosphere.

2. The system according to claim 1, wherein said vent pipe and said second passage communicate with said float chamber at a portion thereof above the fuel.

3. A system for controlling a carburetor of an engine provided with a supecharger having a compressor, comprising:

an intake pipe at an end thereof connected to said compressor;

a chamber communicated with the other end of said intake pipe;

said carburetor includes means comprising a float chamber for supplying fuel to said carburetor;

passage means comprising a first passage communicating with said first-mentioned chamber and a second passage communicating with said float chamber;

an intake passage for communicating said intake pipe with said carburetor via said first-mentioned chamber;

said carburetor includes a vent pipe communicating said float chamber with said intake passage;

a changeover valve provided between said first and second passages;

said changeover valve comprising a diaphragm, a vacuum operated chamber defined by said diaphragm, a third passage communicating said vacuum operated chamber with said intake passage at a downstream side of said carburetor, a first opening communicating said second passage with said first passage so as to communicate said float chamber with said intake pipe via said first-mentioned chamber, and a second opening adapted for communicating said second passage with the atmosphere, a valve body operatively connected to said diaphragm cooperating with said first and second openings respectively; and said vacuum operated chamber and said third passage being such that said valve body closes said first opening and opens said second opening under light load conditions of the engine to communicate said float chamber with the atmosphere.

4. The system according to claim 3 wherein said carburetor further comprises a throttle valve closeably mounted in said intake passage, said third passage communicates with the intake passage at a position adjacent to the downstream side of said throttle valve when the latter is substantially closed.

5. The system according to claim 3 wherein said first-mentioned chamber is between said intake pipe and said intake passage for diminishing the pulsation of intake air.

* * * * *